US012305546B2

(12) United States Patent
Marocco et al.

(10) Patent No.: US 12,305,546 B2
(45) Date of Patent: May 20, 2025

(54) EXHAUST SOUND ATTENUATION AND CONTROL SYSTEM

(71) Applicants: Gregory M. Marocco, Montville, NJ (US); Gregory J. Colletti, Belvidere, NJ (US)

(72) Inventors: Gregory M. Marocco, Montville, NJ (US); Gregory J. Colletti, Belvidere, NJ (US)

( * ) Notice: Subject to any disclaimer, the term of this patent is extended or adjusted under 35 U.S.C. 154(b) by 0 days.

(21) Appl. No.: 18/759,015

(22) Filed: Jun. 28, 2024

(65) Prior Publication Data

US 2024/0352881 A1 Oct. 24, 2024

Related U.S. Application Data

(63) Continuation-in-part of application No. 17/875,349, filed on Jul. 27, 2022, now abandoned.

(51) Int. Cl.
*F01N 1/08* (2006.01)
*F01N 1/02* (2006.01)

(52) U.S. Cl.
CPC ..... *F01N 1/083* (2013.01); *F01N 1/02* (2013.01); *F01N 2470/02* (2013.01)

(58) Field of Classification Search
CPC . F01N 1/02; F01N 1/023; F01N 1/026; F01N 1/083; F01N 13/1894; F01N 2470/02; F01N 2470/18
See application file for complete search history.

(56) References Cited

U.S. PATENT DOCUMENTS

| | | | | |
|---|---|---|---|---|
| 2,727,584 A | | 12/1955 | Marx | |
| 2,881,852 A | | 4/1959 | Morrish | |
| 4,064,962 A | | 12/1977 | Hunt | |
| 5,043,147 A | * | 8/1991 | Knight | F01N 1/084 422/177 |
| 5,304,749 A | | 4/1994 | Crandell | |
| 5,477,014 A | * | 12/1995 | Dunne | B01J 20/183 502/68 |

(Continued)

FOREIGN PATENT DOCUMENTS

| | | | |
|---|---|---|---|
| GB | 744434 | A | 2/1956 |
| GB | 771759 | A | 4/1957 |

*Primary Examiner* — Anthony Ayala Delgado
(74) *Attorney, Agent, or Firm* — Nath, Goldberg & Meyer; Joshua B. Goldberg

(57) ABSTRACT

The exhaust sound attenuation and control system includes an outer housing having an inlet pipe and an outlet pipe at opposite ends thereof. The interior of the housing includes upper, central, and lower exhaust sound attenuation elements. The exhaust gasses from the inlet pipe first enter the upper element and an upper arcuate flow guide directs the gasses leaving the upper element into the central element. A lower arcuate flow guide directs the gasses leaving the central element into the lower element. Gasses exiting the lower element are directed into the outlet pipe and exit the system. The upper element functions primarily as a muffler while the central and lower elements function as both a muffler and a resonator. The upper element includes a central elongated pipe surrounded by an outer housing. The central element includes a plurality of baffle elements. The lower element includes a plurality of baffle plates.

22 Claims, 13 Drawing Sheets

(56) References Cited

U.S. PATENT DOCUMENTS

| | | | | |
|---|---|---|---|---|
| 5,739,484 | A * | 4/1998 | Jones | F01N 1/08 181/275 |
| 6,089,347 | A * | 7/2000 | Flugger | F01N 1/02 181/275 |
| 6,394,225 | B1 | 5/2002 | Yasuda | |
| 6,651,773 | B1 * | 11/2003 | Marocco | F01N 13/0097 181/275 |
| 7,281,606 | B2 * | 10/2007 | Marocco | F01N 1/02 181/275 |
| 7,549,511 | B2 * | 6/2009 | Marocco | F01N 1/08 181/275 |
| 2004/0050618 | A1 * | 3/2004 | Marocco | F01N 13/009 181/258 |
| 2005/0279571 | A1 * | 12/2005 | Marocco | F01N 13/04 181/270 |
| 2006/0090957 | A1 * | 5/2006 | Stuber | F01N 13/0097 181/272 |
| 2007/0205046 | A1 * | 9/2007 | Newberry | F01N 1/083 181/270 |
| 2009/0014238 | A1 * | 1/2009 | Huff | F01N 1/02 181/265 |
| 2009/0107761 | A1 * | 4/2009 | Marocco | F01N 13/141 181/270 |
| 2009/0145689 | A1 | 6/2009 | Han | |
| 2015/0176448 | A1 | 6/2015 | Han et al. | |
| 2017/0044943 | A1 * | 2/2017 | Bartlett | F01N 1/083 |

* cited by examiner

EXHAUST SOUND ATTENUATION AND CONTROL SYSTEM

CROSS-REFERENCE TO RELATED APPLICATION

This continuation-in-part patent application claims priority under 35 U.S.C. § 120 to U.S. patent application Ser. No. 17/875,349, filed on Jul. 27, 2022 in the U.S.P.T.O., the disclosure of which is incorporated by reference herein in its entirety.

TECHNICAL FIELD

The disclosure of the present patent application relates generally to exhaust systems for internal combustion engines, and particularly to an exhaust sound attenuation and control system.

DISCUSSION OF THE RELATED ART

While the internal combustion engine has proven to be a reasonably good power source for motor vehicles, it is not without its drawbacks. One of the chief drawbacks of the internal combustion engine is the noise output that results from the rapid burning of fuel in the combustion chambers of the engine, and the rapid expulsion of the hot exhaust gases into the atmosphere. As a result, legislation in virtually every area of the world requires motor vehicles to have equipment that reduces sound output. Accordingly, mufflers, resonators, and other such sound-attenuating devices have been known for many years, since shortly after the very earliest development of the internal combustion engine. These two types of sound control devices, i.e., mufflers and resonators, have generally not been combined into a single unit due to conflicting characteristics and physical requirements.

Mufflers are generally installed near the output end of an exhaust system, where the exhaust gases have cooled somewhat. Mufflers are adapted to attenuate the sound level of the exhaust through a wide range of frequencies. Relatively low temperature, mild steels are acceptable for such use, the primary consideration for durability being corrosion resistance. Mufflers operate by passing the exhaust gases through a series of pipes within the muffler shell, the pipes generally having a series of smaller passages or orifices in their side walls. The exhaust gases are forced through these side passages by the pressure developed by the operating engine, so that the muffler serves to attenuate the exhaust sound through a relatively wide range of frequencies.

Many exhaust systems also incorporate a resonator. Resonators are also sound attenuation devices, but operate on a completely different principle than that of the muffler. The resonator is adapted to pass the exhaust gases through with little or no impedance, while canceling or absorbing sounds within a certain relatively narrow and well-defined frequency range. This range is generally relatively high frequency noise, the muffler being relied upon for the attenuation of lower exhaust frequencies. The resonator may be placed either upstream or downstream from the muffler and is used to quiet any noises not damped by the other components of the exhaust system. As described above, the single resonator only cancels or absorbs sounds within a certain relatively narrow and well-defined frequency range, leaving many frequencies unabsorbed. Thus, an exhaust sound attenuation and control system solving the aforementioned problems is desired.

SUMMARY

The exhaust sound attenuation and control system includes an outer housing having an inlet pipe and an outlet pipe at opposite ends thereof. The interior of the housing includes an upper exhaust sound attenuation element, a central exhaust sound attenuation element and a lower exhaust sound attenuation element. The exhaust gasses from the inlet pipe first enter the upper element and an upper arcuate flow guide directs the gasses leaving the upper element into the central element. A lower arcuate flow guide directs the gasses leaving the central element into the lower element. Gasses exiting the lower element are directed into the outlet pipe and exit the system. The upper exhaust sound attenuation element functions primarily as a muffler and includes a central elongated pipe surrounded by an outer housing. The central exhaust sound attenuation element functions as both a muffler and a resonator and includes four triangular baffle elements and a central multi-walled baffle element. The relative sizes of the triangular and a multi-walled baffle elements and the ports therein can be adjusted to maximize the attenuation of sound within the central element. The lower exhaust sound attenuation element also functions as both a muffler and a resonator and includes a plurality of planar baffle plates with openings between adjacent planar baffle plates, and a plurality of curved baffle plates functioning as open resonant chambers. The relative sizes of the baffle plates and the openings between them can be adjusted to maximize the attenuation of sound within the lower exhaust sound attenuation element.

These and other features of the present subject matter will become readily apparent upon further review of the following specification.

BRIEF DESCRIPTION OF THE DRAWINGS

The above and other features of the present disclosure will become more apparent by describing in detail exemplary embodiments thereof in conjunction with the accompanying drawings, in which.

DETAILED DESCRIPTION OF THE EMBODIMENTS

Figure 1:
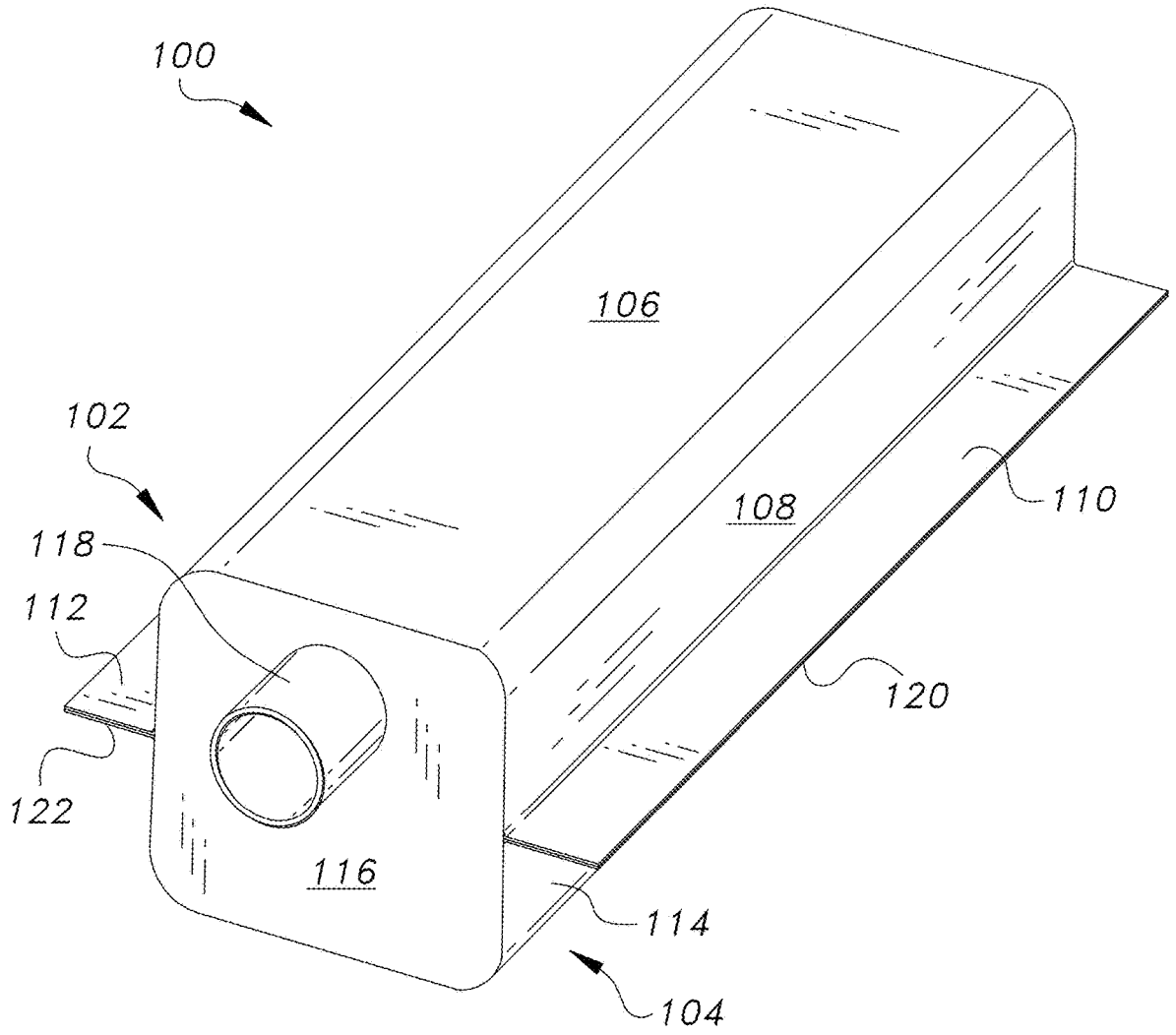
FIG. 1 is a perspective view of an exhaust sound attenuation and control system.

Exemplary embodiments of the present disclosure will be described more fully hereinafter with reference to the accompanying drawings. The present disclosure may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" may include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±12% variation from the nominal value unless otherwise indicated or inferred. The term "approximately" may be used interchangeably with the term "about", and refers to a ±12% variation from the nominal value unless otherwise indicated or inferred.

The term "optional" or "optionally" means that the subsequently described event or circumstance may or may not occur, and that the description includes instances where said event or circumstance occurs and instances in which it does not.

Unless defined otherwise, all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

Figure 2:
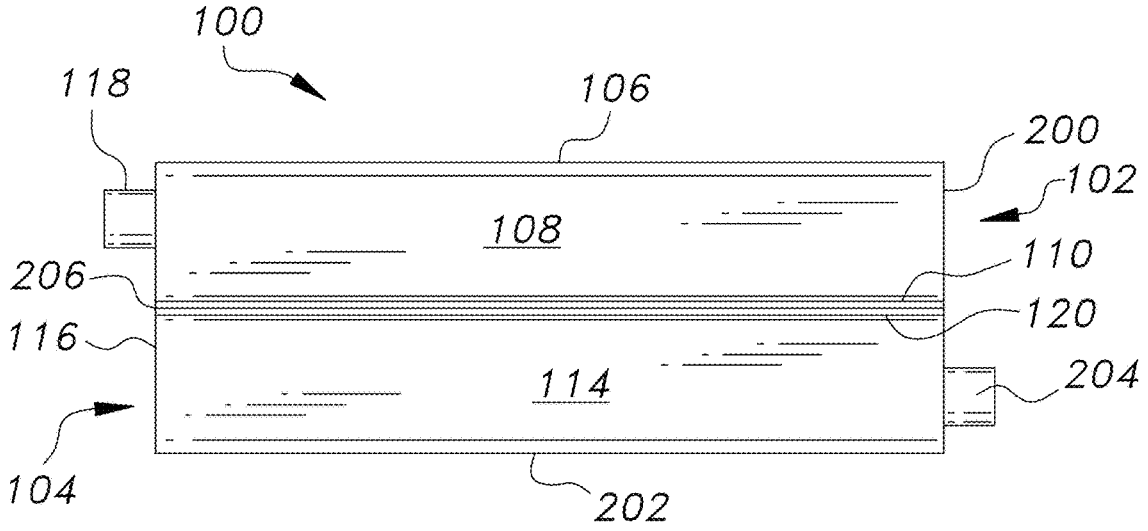
FIG. 2 is a side view of the exhaust sound attenuation and control system of FIG. 1.

The exhaust sound attenuation and control system 100 is illustrated in FIGS. 1-15. The exterior features of the system 100 are shown in FIGS. 1 and 2. The system includes an outer housing having a top housing shell 102 and a bottom housing shell 104. The top housing shell 102 includes a relatively planar horizontal top 106, a relatively planar right side 108 attached to and extending vertically and perpendicularly to the top 106, a right flange 110 attached to and extending horizontally and perpendicularly to the right side 108, and a left flange 112 attached to and extending horizontally and perpendicularly to the relatively planar left side (not shown) of the top housing shell 102. The bottom housing shell 104 is symmetrical to the top housing shell 102

(flipped upside down) and includes a relatively planar horizontal bottom 202, a relatively planar right side 114 attached to and extending vertically and perpendicularly to the bottom 202, a right flange 120 attached to and extending horizontally and perpendicularly to the right side 114 and a left flange 122 attached to and extending horizontally and perpendicularly to the relatively planar left side (not shown) of the bottom housing shell 104. The housing also includes a relatively planar vertical front panel 116 with an inlet pipe 118 extending therethrough, and a relatively planar vertical rear panel 200 with an outlet pipe 204 extending therethrough. The above-described components of the housing may be welded together with, for example, a weld bead 206, as shown in FIG. 2, between the right flanges 110, 120 of the top half and the bottom half of the housing. The components of the housing may be otherwise attached to one another, and some of the components may be formed as integral larger components. It should be noted that the specific outer shape of the housing of the exhaust sound attenuation and control system 100, may be different than the one shown in the drawings, and the shape may be changed to suit the application. For example, while the right 108 and left sides of the top housing shell 102 and the right 114 and left sides of the bottom housing shell 104 are shown having rounded surfaces where they connect to the top 106 and the bottom 202, respectively, they may be flat and connect to the top 106 and the bottom 202 at substantially 90°. In other embodiments, the housing may be oval or round, so that these connections may be at angles other than 90°.

Figure 3:
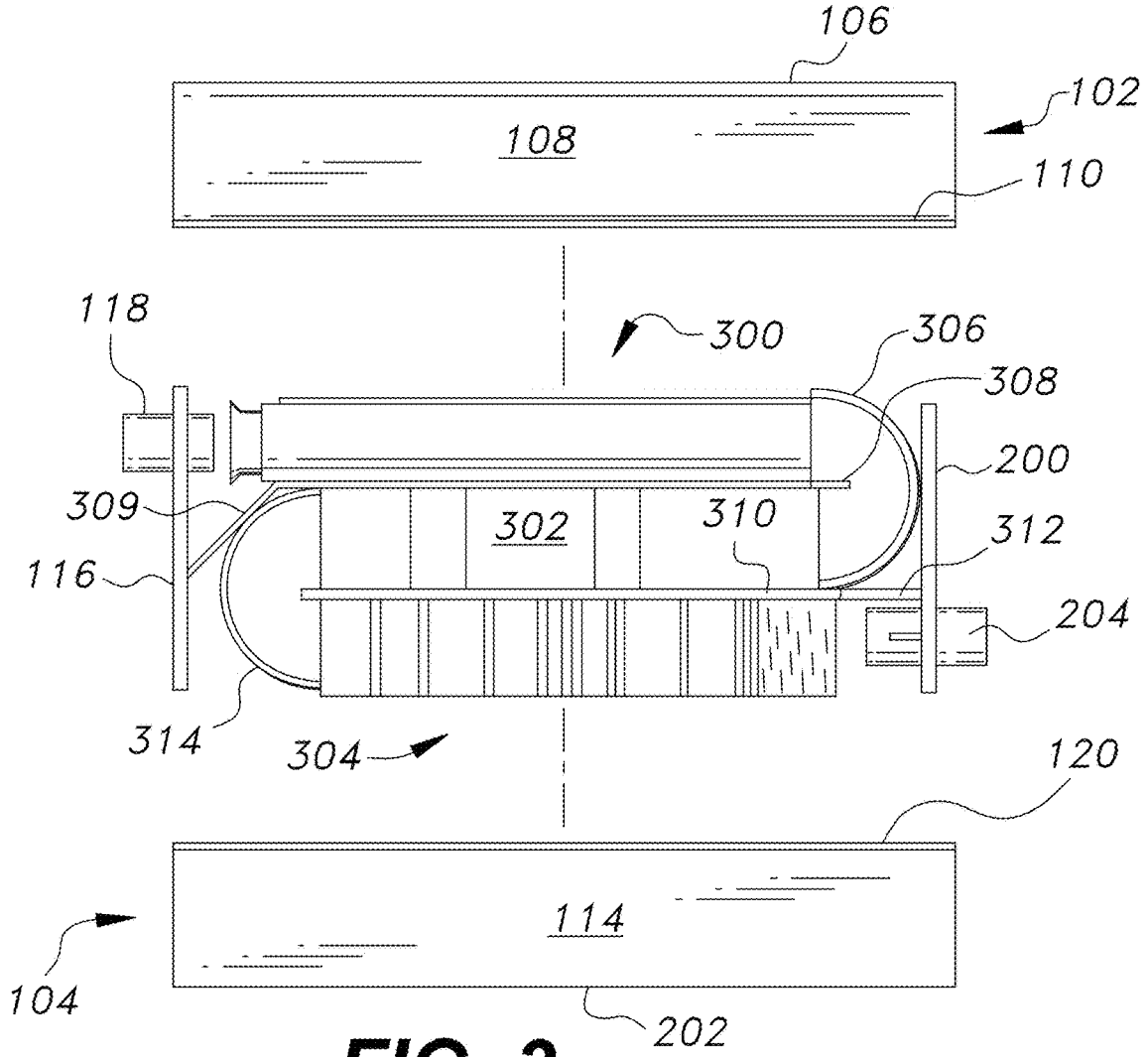
FIG. 3 is an exploded side view of the exhaust sound attenuation and control system of FIG. 1, showing the internal components of the device.

The internal components of the exhaust sound attenuation and control system 100 are shown generally in FIG. 3. The system 100 includes an upper exhaust sound attenuation element 300, a central exhaust sound attenuation element 302, and a lower exhaust sound attenuation element 304. An upper arcuate flow guide 306 directs the gasses leaving the upper element 300 into the central element 302. An upper element support plate 308 is attached to the front panel 116 using an upper element support plate bracket 309. The upper element support plate 308 supports the upper element 300 and separates the upper element 300 from the central element 302. A lower element support plate 310 is attached to the rear panel 200 and extends perpendicularly therefrom. The lower element support plate 310 supports the central element 302 and separates the central element 302 from the lower element 304. A lower arcuate flow guide 314 directs the gasses leaving the central element 302 into the lower element 304. The upper arcuate flow guide 306 and a rear portion 312 of the lower element support plate 310 are perforated, to allow a portion of the gasses exiting the upper element 300 to bypass the central element 302 and the lower element 304 before exiting the system 100 via the outlet pipe 204.

Figure 4:
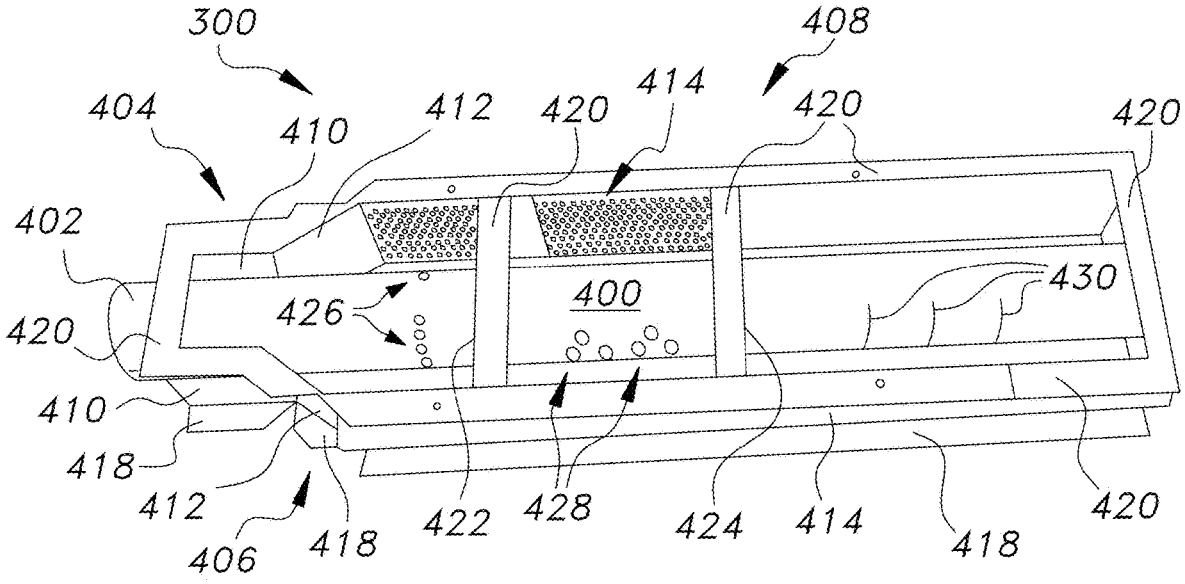
FIG. 4 is a perspective view of an upper exhaust sound attenuation element of the exhaust sound attenuation and control system of FIG. 1.
Figure 5:
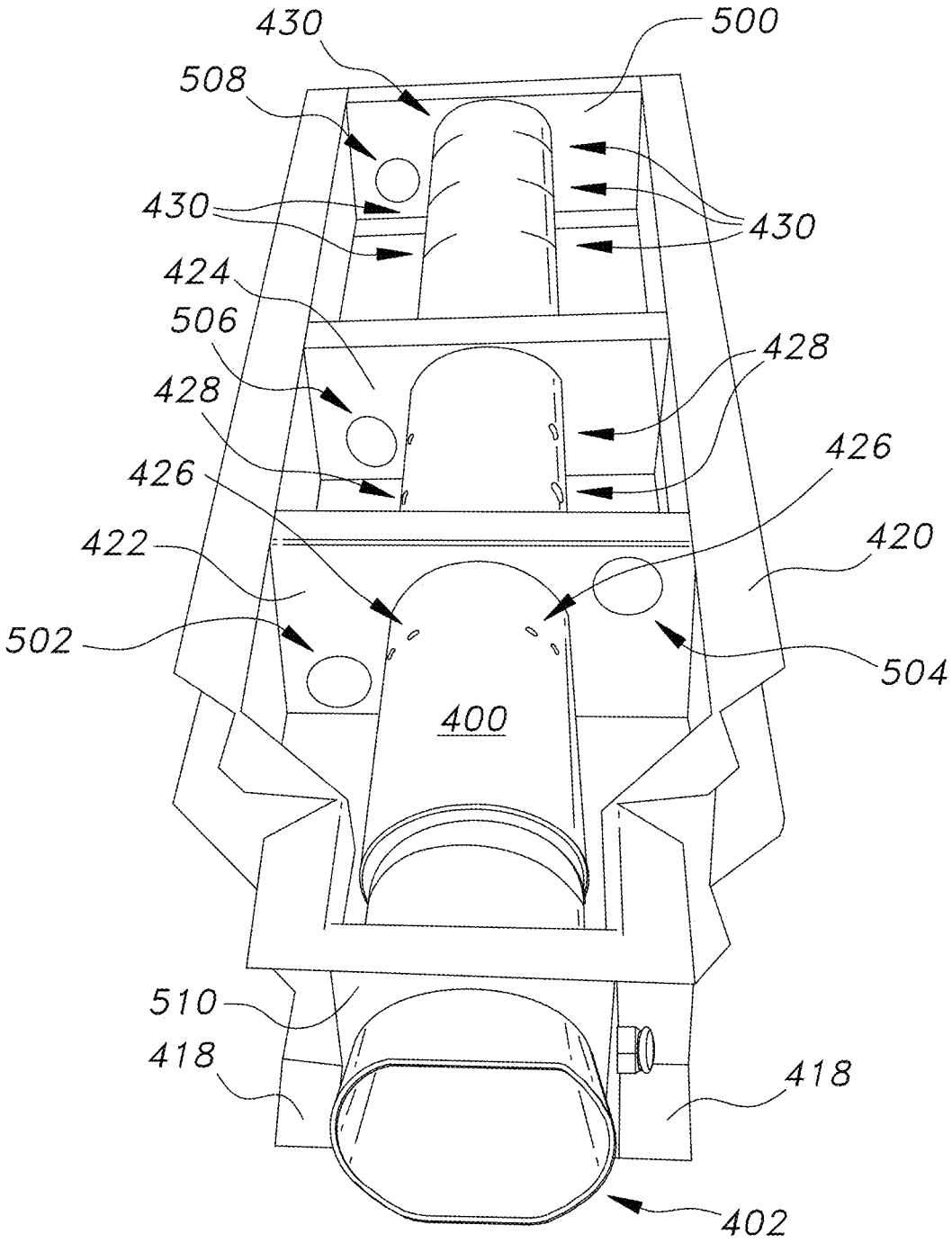
FIG. 5 is another perspective view of the upper exhaust sound attenuation element of FIG. 4, as seen from above and in front of the element.

The details of the upper element 300 are shown in FIGS. 4 and 5. The upper element 300 includes a central elongated pipe 400 with a flared or straight inlet 402 that is spaced from the inner end of the inlet pipe 118 for receiving the gasses entering the system 100 from an internal combustion engine (not shown). The gap between the inlet 402 and the inner end of the inlet pipe 118 (see FIG. 3) can be adjusted for tuning, depending on the particular application). The upper element 300 also includes an outer housing having a narrow portion 404 closest to the input of the upper element 300, a flared portion 406 attached to the narrow portion 404 at its narrow end, and a wide portion 408 attached to the wide end of the flared portion 406. The narrow portion 404 of the housing includes vertical side walls 410, the flared portion 406 includes vertical side walls 412, and the wide portion 408 includes vertical side walls 414. The wide portion 408 of the outer housing includes a vertical front baffle plate 422 and a vertical central baffle plate 424, through which the pipe 400 extends. The front end of the narrow portion 404 has a sealed, vertical front wall 510 through which the pipe 400 extends, and the back end of the wide portion 408 includes a vertical rear baffle plate 500 that may or may not seal the end of the pipe 400, depending on tuning. The bottoms of the side walls 410, 412, 414, the front wall 510, and baffle plates 422, 424, 500 have horizontal lower flanges 418 for welding or otherwise attaching them to the upper element support plate 308. The tops of the side walls 410, 412, 414, the front wall 510, and baffle plates 422, 424, 500 have horizontal upper flanges 420 for welding or otherwise attaching them to the interior surface of the top 106 of the top housing shell 102. The vertical side walls 414 may be perforated, solid or have a combination of perforated and solid areas. The item 414 may or may not be present depending on requirements.

The central elongated pipe 400 includes ten small through-holes 426 arranged in a radial pattern (five on each side) in the wide portion 408 of the outer housing between the flared inlet 402 and the front baffle plate 422, adjacent to the front baffle plate 422. The central elongated pipe 400 also includes twelve larger through holes 428 arranged in triangular patterns (six on each side) in the wide portion 408 of the outer housing, between the front baffle plate 422 and the central baffle plate 424. In addition, the pipe 400 includes six vertical, lateral slots 430 (three on each side) in the wide portion 408 of the outer housing, between the central baffle plate 424 and the rear baffle plate 500. The front baffle plate 422 includes a lower port 502 adjacent its lower left corner and an upper port 504 adjacent its upper right corner. The central baffle plate 424 includes a lower port 506 adjacent its lower left corner and substantially aligned with the lower port 502 of the front baffle plate 422. The rear baffle plate 500 includes a lower port 508 adjacent its lower left corner and substantially aligned with the lower port 502 of the front baffle plate 422 and the lower port 506 of the central baffle plate 424.

In operation, in the embodiment as shown, the exhaust gasses enter the inlet 402 of the pipe 400 and exit holes 426, 428 and slots 430. The gasses exiting the holes 426 pass through ports 502, 504 in the front baffle plate 422 to combine with the gasses exiting holes 428. The mixed gasses pass through the port 506 in the central baffle plate 424 to further mix with the gasses exiting the slots 430. The combined gasses exit the upper element 300 through the port 508 in the rear baffle plate 500. It should be noted that this is simply an example of the gas flow through element 300. For example, holes 426, 428 and slots 430 can be in the shape of other passages, or may be eliminated completely for tuning purposes. In addition, while the pipe 400 is shown circular in cross section, it should be noted that other shapes, including those with concave features, may be used. The front baffle plate 422, the central baffle plate 424, and the rear baffle plate 500 may include circular ports (as shown); passages in other shapes such as slots; or may be solid without passages or ports, for tuning purposes. In some embodiments, an optional smaller tube, with or without passages, may pass through all or some of the baffle plates 422, 424, 500, for example, in the area of the ports 502, 506 and 508. Thus, other gas flow directions are possible, depending on the tuning and application of the muffler 100. The upper element 300 functions primarily as a tunable muffler.

Figure 6:
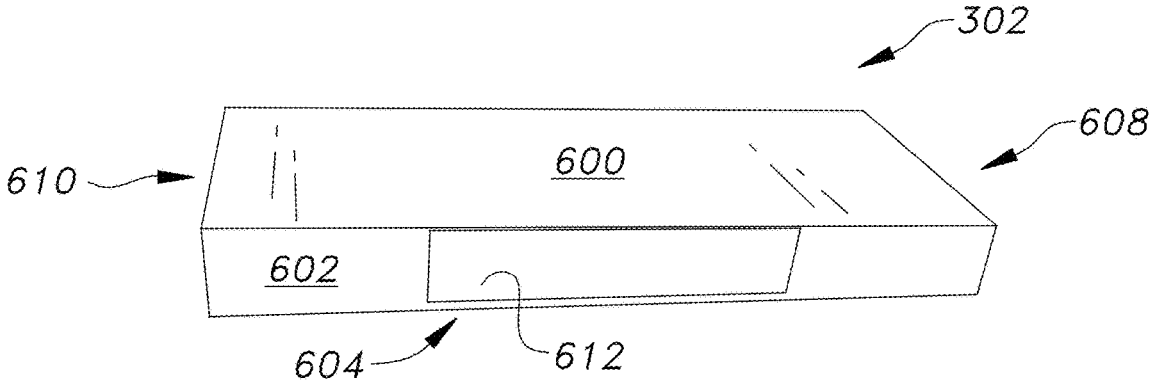
FIG. 6 is a perspective view of a central exhaust sound attenuation element of the exhaust sound attenuation and control system of FIG. 1.
Figure 7:
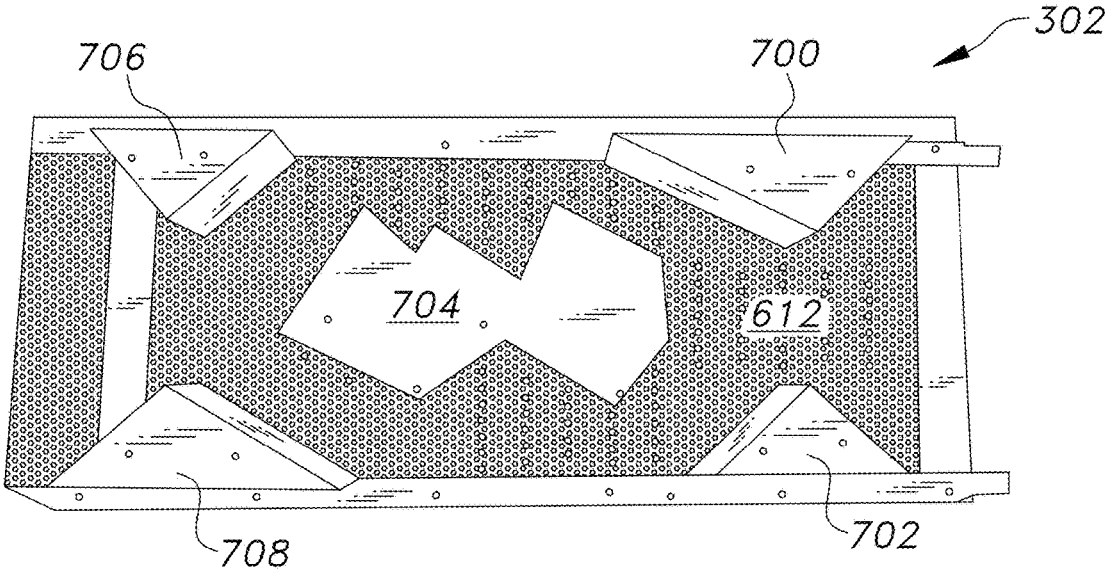
FIG. 7 is a top view of the central exhaust sound attenuation element of FIG. 6, with its cover removed to show the internal components thereof.
Figure 8:
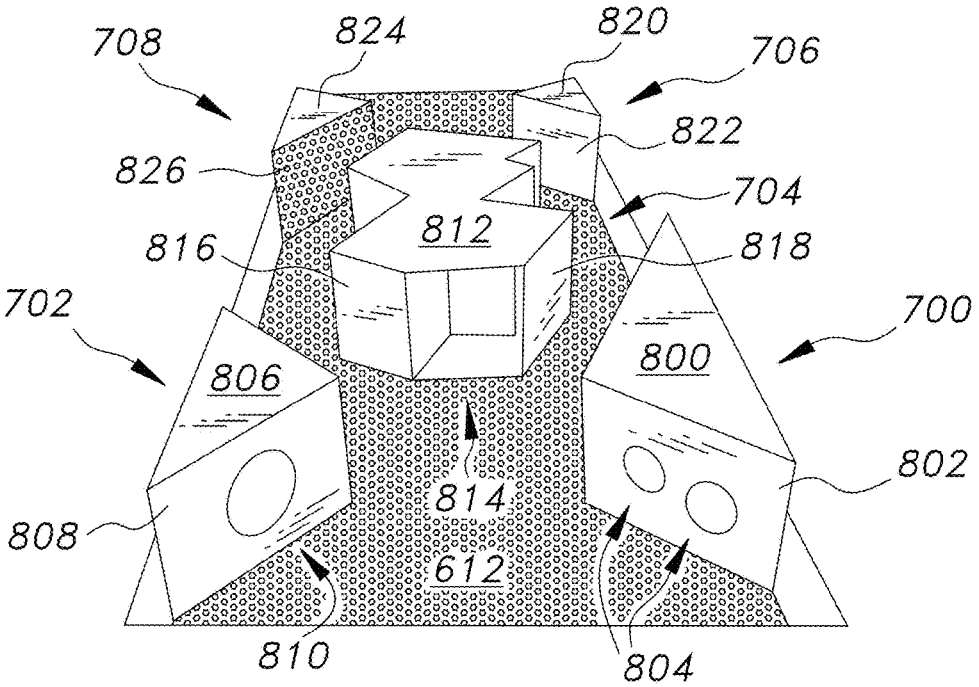
FIG. 8 is a perspective view of the central exhaust sound attenuation element of FIG. 6 as seen from in front of the element, with its cover removed to show the internal components thereof.
Figure 9:
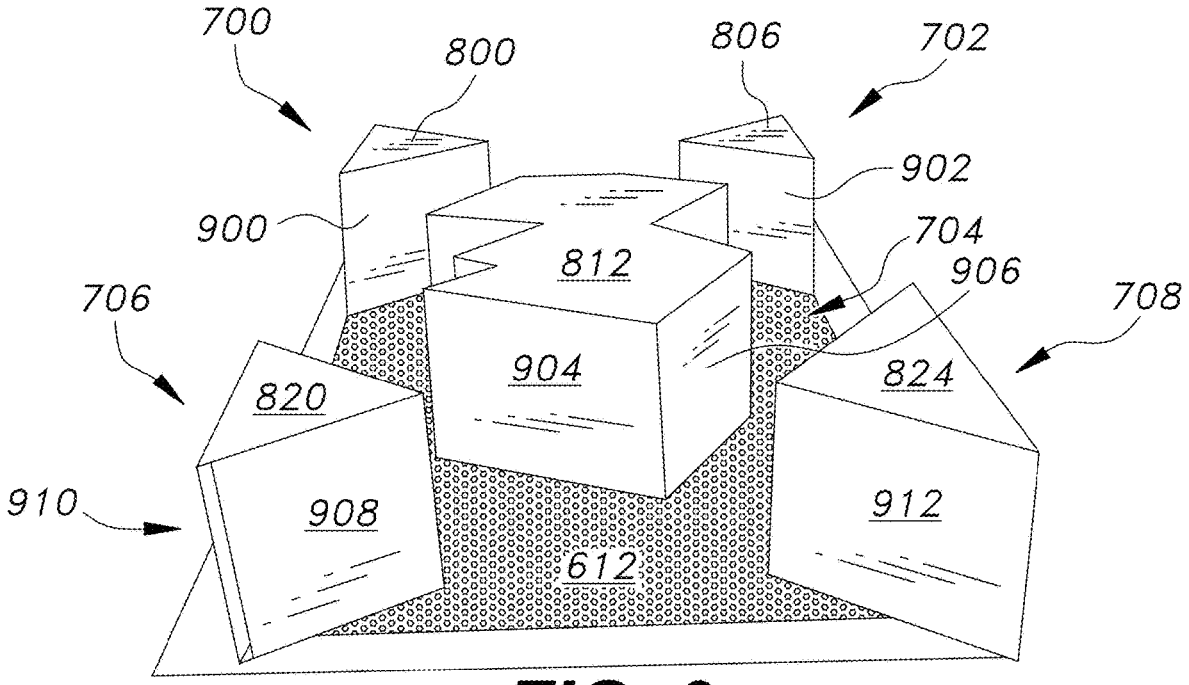
FIG. 9 is a perspective view of the central exhaust sound attenuation element of FIG. 6 as seen from the rear of the element, with its cover removed to show the internal components thereof.
Figure 10:
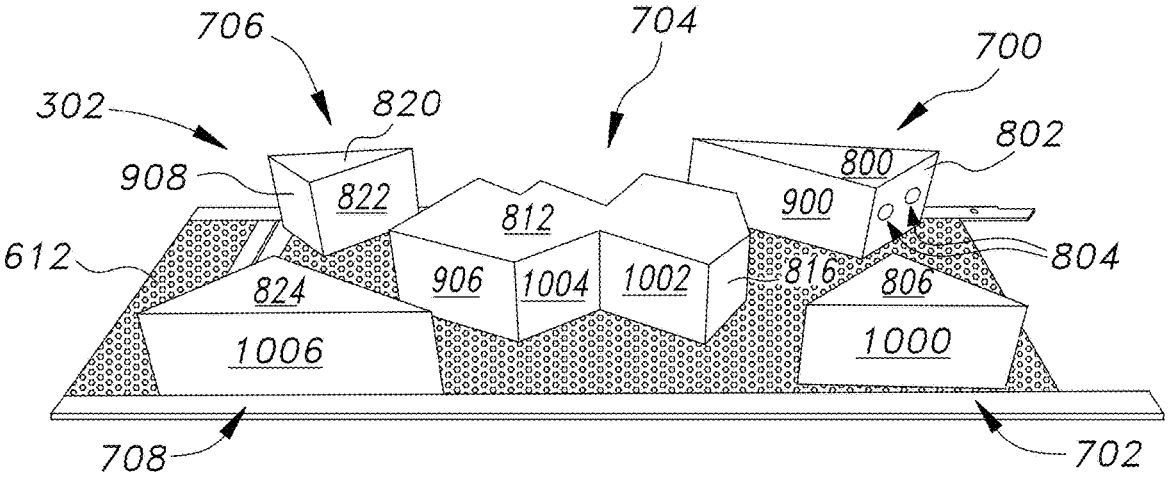
FIG. 10 is a perspective view of the central exhaust sound attenuation element of FIG. 6 as seen from the left side, with its cover removed to show the internal components thereof.
Figure 11:
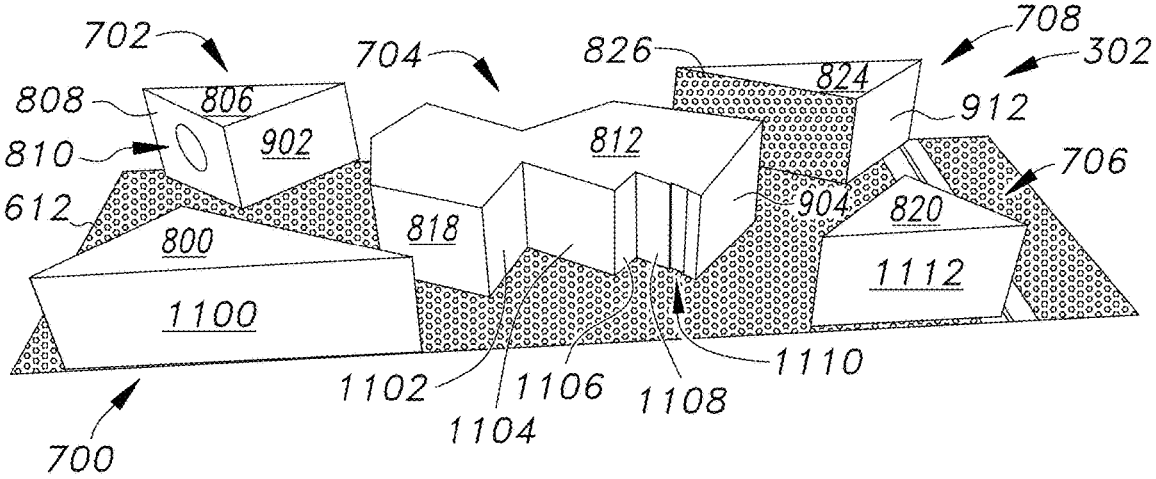
FIG. 11 is a perspective view of the central exhaust sound attenuation element of FIG. 6 as seen from the right side, with its cover removed to show the internal components thereof.

The exterior of the central element 302 is shown in FIG. 6. The central element 302 includes a housing with a top wall 600, a left sidewall 602, a right sidewall (not shown, but symmetrical to the left sidewall 602), an open inlet end 608, an open outlet end 610 and a bottom wall 612. Each one of the left and right sidewalls includes an opening 604 equally spaced from the open ends 608, 610. The bottom wall 612 may be perforated, as shown, or may be solid, or solid in some areas and perforated in others.

In FIGS. 7-11, the top and sides of the housing of the central element 302 have been removed to show the interior details of the central element 302. Within its housing, the central element 302 includes a plurality of multi-walled baffle elements including a right, front triangular baffle element 700 and a left, front triangular baffle element 702 adjacent the open inlet end 608 of the housing, a central multi-walled baffle element 704, and a right, rear triangular baffle element 706 and a left, rear triangular baffle element 708 adjacent the open outlet end 610 of the housing. The right, front triangular baffle element 700 includes a solid, planar, triangular top wall 800, a front, ported sidewall 802 with two circular ports 804 therethrough, a solid rear sidewall 900 and a solid outside wall 1100. The solid outside wall 1100 abuts the right sidewall and extends between the open inlet end 608 of the housing and the opening 604 in the right sidewall. The left, front triangular baffle element 702 includes a solid, planar, triangular top wall 806, a front ported sidewall 808 with a central, circular port 810, a solid rear sidewall 902 and a solid outside wall 1000. The solid outside wall 1000 abuts the left sidewall 602 and extends between the open inlet end 608 of the housing and the opening 604 in the left sidewall 602.

The right, rear triangular baffle element 706 includes a solid, planar, triangular top wall 820, a solid front sidewall 822, a rear, ported sidewall 908 with a slot port 910 extending vertically at the back edge of the rear sidewall 908, and a solid outside wall 1112. The solid outside wall 1112 abuts the right sidewall and extends between the opening 604 and the open outlet end 610 of the housing. The left, rear triangular baffle element 708 includes a solid, planar, triangular top wall 824, a perforated (ported) front sidewall 826, a solid rear sidewall 912, and a solid outside wall 1006. The solid outside wall 1006 abuts the left sidewall 602 and extends between the opening 604 and the open outlet end 610 of the housing.

The central multi-walled baffle element 704 includes: a polygonal top wall 812 and an open front end 814 extending substantially perpendicular to the direction of gas flow through the central element 302; a left front sidewall 816 opposite the solid rear sidewall 902 of the left front triangular baffle element 702; a right front sidewall 818 opposite the solid rear sidewall 900 of the right front triangular baffle element 700 and extending at an obtuse angle from the open front end; a right rear sidewall 904 opposite the solid front sidewall 822 of the right, rear triangular baffle element 706; and a left rear sidewall 906 opposite the perforated front sidewall 826 of the left, rear triangular baffle element 708. Extending between the left front sidewall 816 and the left rear sidewall 906 are two middle sidewalls. A first middle left sidewall 1002 is attached to and extends approximately at 90° from the left front sidewall 816. A second middle left sidewall 1004 is attached to and extends from the first middle left sidewall 1002 at an obtuse angle. The left sidewalls 1002, 1004 are positioned between the opening 604 of the left sidewall 602 and the opening 604 of the right sidewall. A first middle right sidewall 1102 of the central multi-walled baffle element is attached to and extends approximately at 90° from the right front sidewall 818. A second middle right sidewall 1104 is attached to and extends approximately at 90° from the first middle right sidewall 1102. A third middle right sidewall 1106 is attached to and extends approximately at 90° from the second middle right sidewall 1104. A fourth middle right sidewall 1108 is attached to and extends between the third middle right sidewall 1106 and the right rear sidewall 904 and extends approximately at 90° from both. The fourth middle right sidewall 1108 includes a vertical slot port 1110 close to the right rear sidewall 904. The right sidewalls 1102, 1104, 1106, 1108 are positioned between the opening 604 of the left sidewall 602 and the opening 604 of the right sidewall.

The triangular baffle elements 700, 702, 706, 708 function as ported resonant cavities and are tuned to attenuate various frequency ranges. In addition, the central multi-walled baffle element 704 also acts as a ported resonant cavity and also diverts some of the gasses through its open front end 814 and out the vertical slot port 1110 of the fourth middle right sidewall 1108. In addition, the walls of the various elements 700, 702, 704, 706, 708 that are opposite one another set up destructive interference in certain frequency ranges. The central element 302 uses the above-described properties to attenuate sound within the element 302, functioning both as a muffler and a resonator. The relative sizes of the elements 700, 702, 704, 706, 708 and the ports therein can be adjusted to maximize the attenuation of sound within the element 302. It should be noted that the solid outside walls 1000, 1006, 1100, 1112 of the triangular baffle elements 700, 702, 706, 708 can be omitted and the outside walls of the elements may be sealed by the outer housing. Also note, triangular elements 700, 702, 706, 708 and polygonal element 704 top and bottom walls may be formed individually or by the upper support plate 308 and lower support plate 310.

Figure 12:
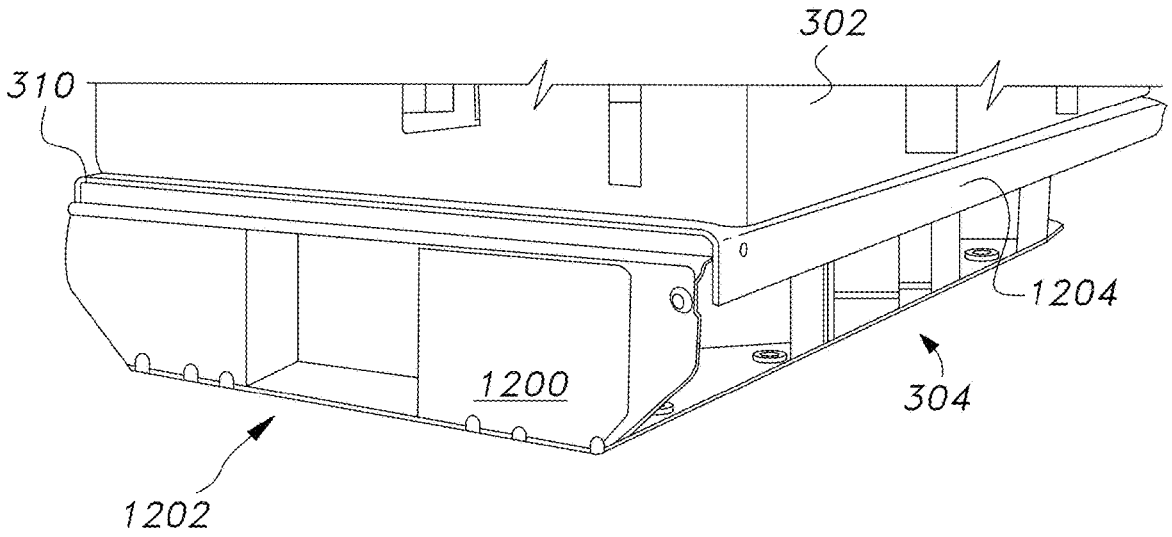
FIG. 12 is a perspective view of a lower exhaust sound attenuation element of the exhaust sound attenuation and control system of FIG. 1 as seen from in front of the element.
Figure 13:
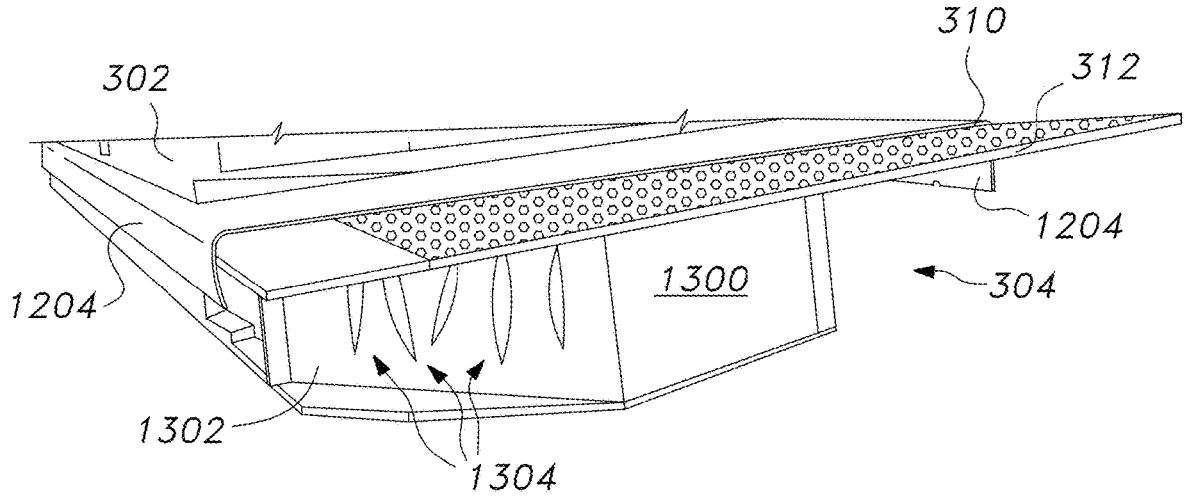
FIG. 13 is a perspective view of the lower exhaust sound attenuation element of the exhaust sound attenuation and control system of FIG. 12, as seen from the rear of the element.
Figure 14:
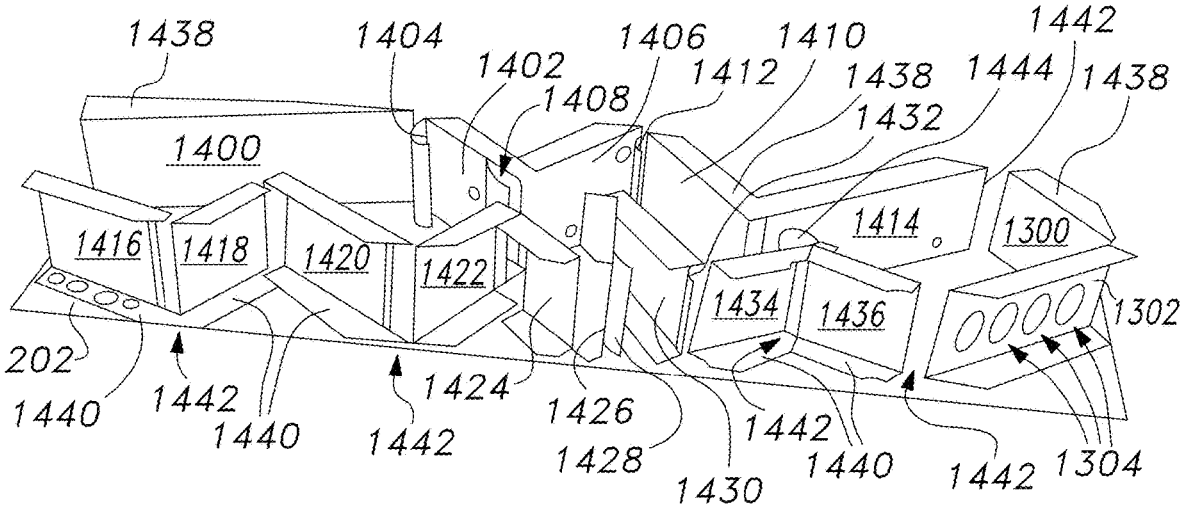
FIG. 14 is a perspective view of a lower exhaust sound attenuation element of the exhaust sound attenuation and control system of FIG. 1 as seen from above the element.

The details of the lower exhaust sound attenuation element 304 are shown in FIGS. 12-14. As shown in FIG. 12, the front (intake) end of the lower element 304 includes a front end plate 1200 with an inlet opening 1202 for receiving gasses from the central element 302. The front end plate 1200 may have additional openings or ports. The lower element support plate 310 includes left and right side flanges 1204 that are attached to and extend downwardly from the right and left sides of the lower element support plate 310. The flanges 1204, may or may not be present depending on welding requirements, cover the upper portion of the sides of the lower element 304, the lower portion of the lower element 304 being open within the bottom housing shell 104. As shown in FIG. 13, the rear (output) end of the lower element 304 includes a solid left rear baffle plate 1300 and a ported right rear baffle plate 1302. The ported right rear baffle plate 1302 includes a plurality of vertical vent slots 1304 through which the gasses exit the lower element 304 and mix with the gasses passing through the perforated rear portion 312 of the lower element support plate 310. It should be noted that slots 1304 may be passages or ports with other shapes, such as circular, for example, and the rear portion 312 of the lower element support plate 310 may be perforated, as shown, solid, or have a combination of solid and perforated areas.

The details of the interior of the lower exhaust sound attenuation element 304 are shown in FIG. 13. The left side of the lower element 304 includes a plurality of planar, vertical baffle plates, including a left front baffle plate 1400 (shown in FIG. 14), and a first left intermediate baffle plate 1402. The left front baffle plate 1400 extends substantially in the longitudinal direction relative to the lower element 304, its front end being slightly farther from the left side of the bottom housing shell 104 than its back end such the left front baffle plate 1400 slightly slants outwardly from front to back. The first left intermediate baffle plate 1402 slants inwardly from front to back and extends at an obtuse angle from adjacent the back end of the left front baffle plate 1400. A curved baffle plate 1404 extends from the front edge of the first left intermediate baffle plate 1402. A second left intermediate baffle plate 1406 extends at approximately 90° from adjacent the rear edge of the first left intermediate baffle plate 1402 and slants outwardly from front to back. A curved baffle plate 1408 extends from the front edge of the second left intermediate baffle plate 1406. A third left intermediate baffle plate 1410 extends at a slightly acute angle from adjacent the back end of the second left intermediate baffle plate 1406 and slants inwardly from front to back. A curved baffle plate 1412 extends from the front edge of the third left intermediate baffle plate 1410. A fourth left intermediate baffle plate 1414 extends at approximately 90° from adjacent the rear edge of the third left intermediate baffle plate 1410 and slants outwardly from front to back. The solid left rear baffle plate 1300 extends at an obtuse angle from adjacent the back end of the fourth left intermediate baffle plate 1414 and slants inwardly from front to back, its back end being welded to (or otherwise attached to) the back end of the ported right rear baffle plate 1302 (see FIG. 13).

Similarly, the right side of the lower element 304 includes a plurality of planar, vertical baffle plates, including a right front baffle plate 1416 and a first right intermediate baffle plate 1418. The right front baffle plate 1416 extends at an acute angle to the longitudinal direction relative to the lower element 304, its front end being farther from the right side 114 of the bottom housing shell 104 than its back end, such the right front baffle plate 1416 slants outwardly from front to back. The first right intermediate baffle plate 1418 slants inwardly from front to back and extends at a slightly obtuse angle from adjacent the back end of the right front baffle plate 1416. A second right intermediate baffle plate 1420 extends at a slightly acute angle from adjacent the rear edge of the first right intermediate baffle plate 1418 and slants outwardly from front to back. A third right intermediate baffle plate 1422 extends at approximately 90° from adjacent the back end of the second right intermediate baffle plate 1420 and slants inwardly from front to back. A fourth right intermediate baffle plate 1424 extends at a slightly acute angle from adjacent the rear edge of the third right intermediate baffle plate 1422 and slants outwardly from front to back. A fifth right intermediate baffle plate 1426 extends at an acute angle from adjacent the rear edge of the fourth right intermediate baffle plate 1424 and slants inwardly from front to back, at an angle close to the lateral direction relative to the lower element 304. A curved baffle plate 1428 extends from the outer front edge of the fifth right intermediate baffle plate 1426. A sixth right intermediate baffle plate 1430 extends at an acute angle from adjacent the inner, rear edge of the fifth right intermediate baffle plate 1426 and slants outwardly from front to back. A curved baffle plate 1432 extends from the outer back edge of the sixth right intermediate baffle plate 1430. A seventh right intermediate baffle plate 1434 extends at approximately 90° from adjacent the back end of the sixth right intermediate baffle plate 1430 and slants inwardly from front to back. An eighth right intermediate baffle plate 1436 extends at an obtuse angle from adjacent the rear edge of the seventh right intermediate baffle plate 1434 and slants outwardly from front to back, with its back edge adjacent the front edge of the ported right rear baffle plate 1302. A curved baffle plate 1444 extends around the opening between baffle plates 1434, 1436

The top edges of the baffle plates 1300, 1302, 1400, 1402, 1406, 1410, 1414, 1416, 1418, 1420, 1422, 1424, 1426, 1430, 1434, 1436 may optionally include upper flanges 1438 for welding or otherwise attaching the baffle plates 1300, 1302, 1400, 1402, 1406, 1410, 1414, 1416, 1418, 1420, 1422, 1424, 1426, 1430, 1434, 1436 to the lower element support plate 310, or they may be directly welded or otherwise attached to the lower element support plate 310. Similarly, the bottom edges of the baffle plates 1300, 1302, 1400, 1402, 1406, 1410, 1414, 1416, 1418, 1420, 1422, 1424, 1426, 1430, 1434, 1436 may optionally include lower flanges 1440 for welding or otherwise attaching the baffle plates 1300, 1302, 1400, 1402, 1406, 1410, 1414, 1416, 1418, 1420, 1422, 1424, 1426, 1430, 1434, 1436 to the bottom 202 of the bottom housing shell 104, or they may be directly welded or otherwise attached to bottom 202.

The baffle plates 1300, 1302, 1400, 1402, 1406, 1410, 1414, 1416, 1418, 1420, 1422, 1424, 1426, 1430, 1434, 1436 do not directly abut one another, (other than the solid left rear baffle plate 1300 and the ported right rear baffle plate 1302), and there are openings 1442 between adjacent baffle plates. The openings 1442 provide multiple flow paths for the exhaust gasses, while the opposing surfaces between the planar baffle plates set up destructive interference over multiple frequency ranges. In addition, the curved baffle plates 1404, 1408, 1412, 1428, 1432, 1444, in combination with the lower element support plate 310 and the bottom 202 of the bottom housing shell 104, form open resonant chambers, their openings directed downstream from the flow of the exhaust gasses. The lower exhaust sound attenuation element 304 uses the above-described features to attenuate sound within the element 304, functioning both as a muffler and a resonator. The relative sizes of the baffle plates 1300, 1302, 1400, 1402, 1406, 1410, 1414, 1416, 1418, 1420, 1422, 1424, 1426, 1430, 1434, 1436 and the openings 1442 between them can be adjusted to maximize the attenuation of sound within the element 304. It should be understood that the lower element 304, as shown in FIG. 14, may be formed with either end as the inlet and outlet, so long as all gasses pass through and/or around the baffle plates 1300, 1302, 1400, 1402, 1406, 1410, 1414, 1416, 1418, 1420, 1422, 1424, 1426, 1430, 1434, 1436.

Figure 15:
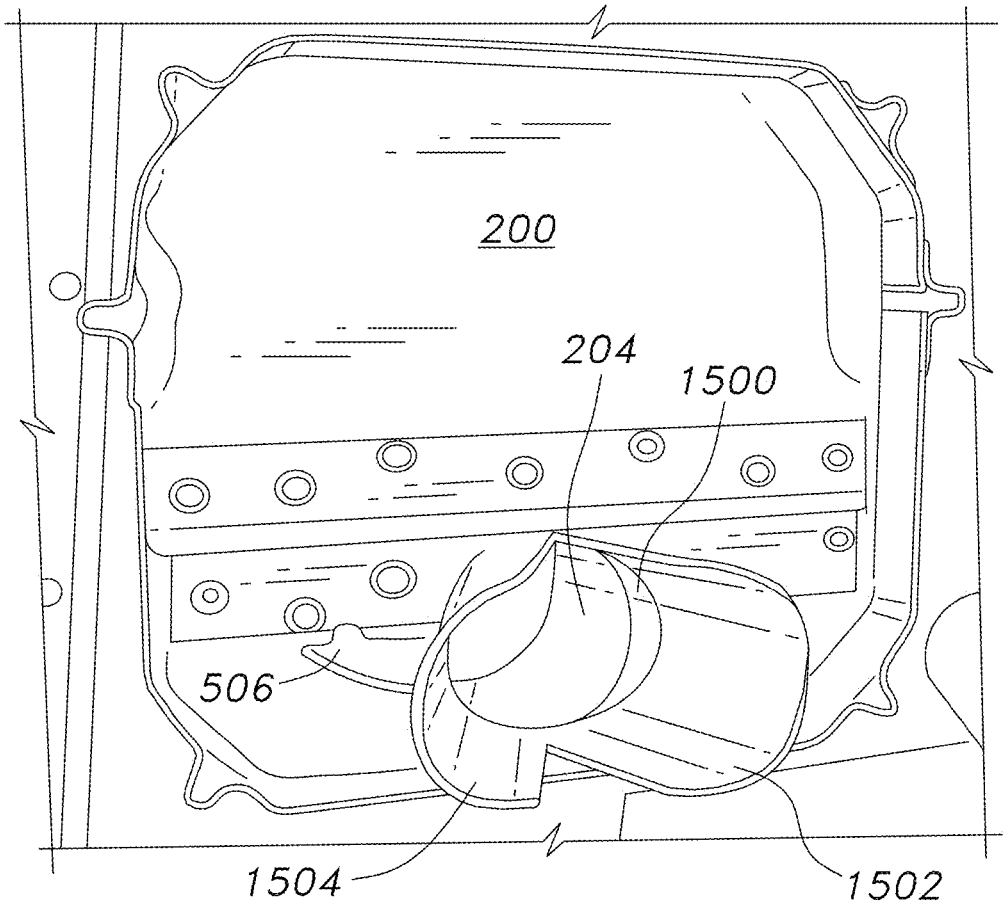
FIG. 15 is a perspective view of a rear plate of the exhaust sound attenuation and control system of FIG. 1 as seen from the interior of the element.
Figure 16:
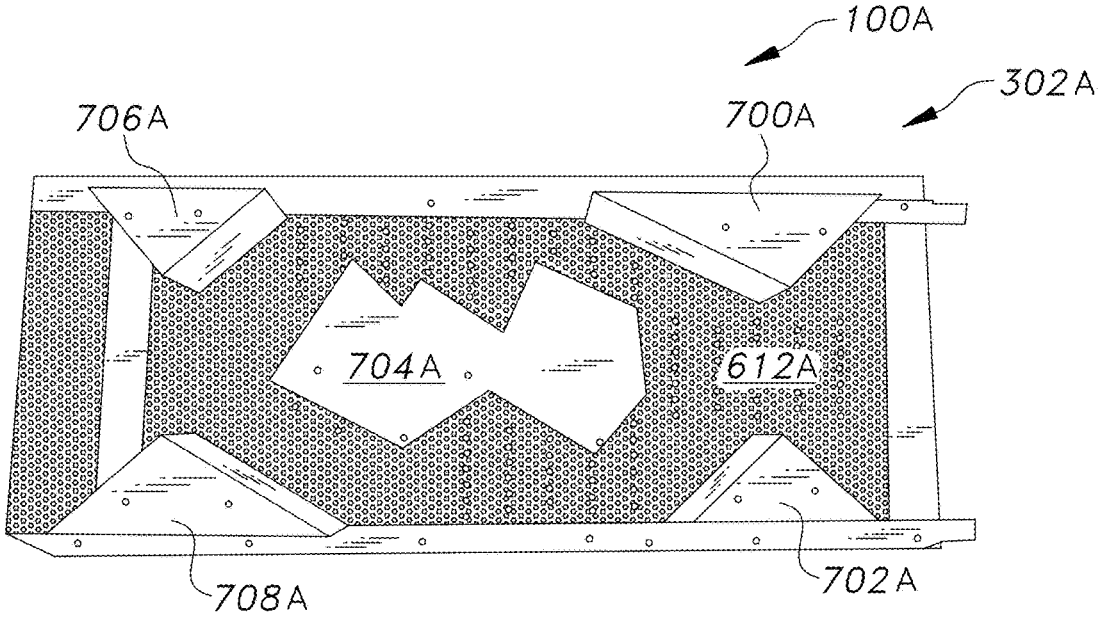
FIG. 16 is a top view of a central exhaust sound attenuation element of an exhaust sound attenuation and control system according to an alternate embodiment, the central exhaust sound attenuation element of FIG. 16 is shown with its cover removed to clearly illustrate the internal components thereof.
Figure 17:
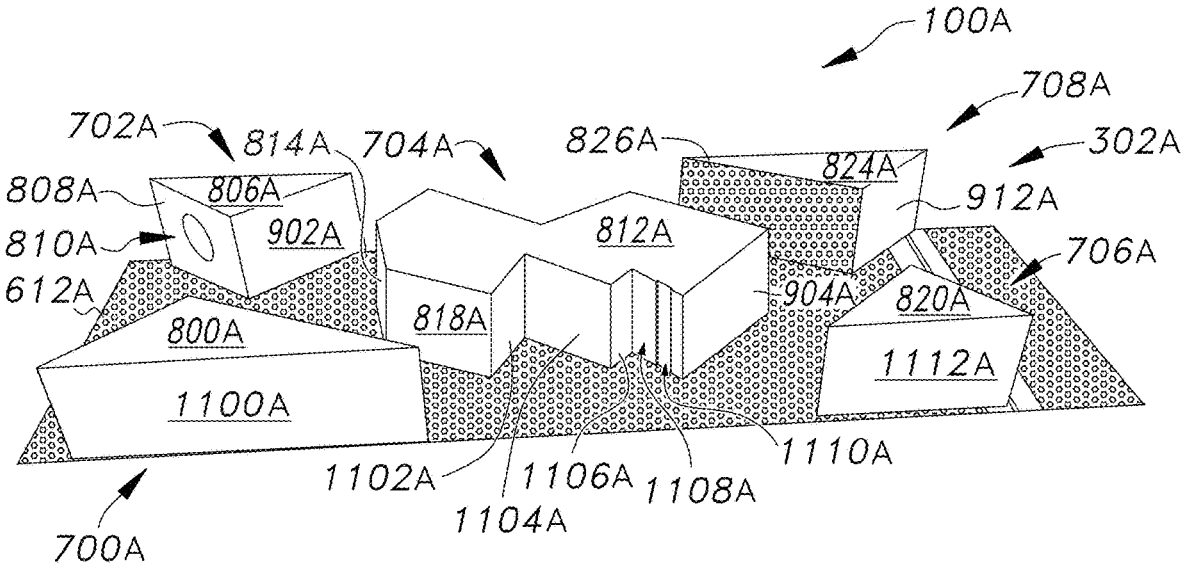
FIG. 17 is a perspective view of the central exhaust sound attenuation element of FIG. 16 as seen from the right side, with its cover removed to show the internal components thereof.

The details of the interior of the rear panel 200 and the outlet pipe 204 are shown in FIG. 15. The inner circular edge 1500 of the outlet pipe 204 has a right half-cylinder outlet funnel 1502 and a left half-cylinder outlet funnel 1504 attached thereto. The right half-cylinder outlet funnel 1502 and the left half-cylinder outlet funnel 1504 are angled outwardly, thereby forming a partial funnel for directing the exhaust gasses into the outlet pipe 204. Each half-cylinder outlet funnel 1502, 1504 is supported by a half-cylinder support flange 1506 (only the left being shown). The half-cylinder support flanges 1506 are triangular and extend between the back side of the half-cylinder outlet funnels 1502, 1504 and the interior surface of the rear panel 200.

In an alternate embodiment, as described with reference to FIGS. 16 to 19, an exhaust sound attenuation and control system 100A is the same as the exhaust sound attenuation and control system 100 described in this specification except for the configuration of the central multi-walled baffle element (having reference numeral 704A) of the central element of the system 100A. Except for this difference, the exhaust sound attenuation and control system 100A includes all the other components/aspects as described in this specification with reference to the exhaust sound attenuation and control system 100. For this reason, a detailed description of these components/aspects will be omitted below for brevity purposes (and to avoid duplicity of information). Aspects/components of the exhaust sound attenuation and control system 100A not described in detail below may be assumed to be the same as or substantially similar to corresponding aspects/components of the exhaust sound attenuation and control system 100 described in this specification.

With reference to FIGS. 16-19, in the exhaust sound attenuation and control system 100A, the top and sides of the housing of a central element 302A of the exhaust sound attenuation and control system 100A have been removed to show the interior details of the central element 302A. Within its housing, the central element 302A includes a plurality of multi-walled baffle elements including a right, front triangular baffle element 700A, a left, front triangular baffle element 702A adjacent the open inlet end 608 of the housing (see FIG. 6 for the open inlet end 608), the central multi-walled baffle element 704A, a right, rear triangular baffle element 706A, and a left, rear triangular baffle element 708A adjacent the open outlet end 610 of the housing (see FIG. 6 for the open outlet end 610 of the housing).

Referring to FIGS. 16-19, the central multi-walled baffle element 704A includes: a polygonal top wall 812A and an open front end 814A extending substantially perpendicular to the direction of gas flow through the central element 302A; a left front sidewall 816A opposite a solid rear sidewall of the left front triangular baffle element 702A; a right front sidewall 818A opposite a solid rear sidewall of the right front triangular baffle element 700A and extending at an obtuse angle from the open front end 814A; a right rear sidewall 904A opposite a solid front sidewall of the right, rear triangular baffle element 706A; and a left rear sidewall 906A opposite a perforated front sidewall of the left, rear triangular baffle element 708A.

Figure 18:
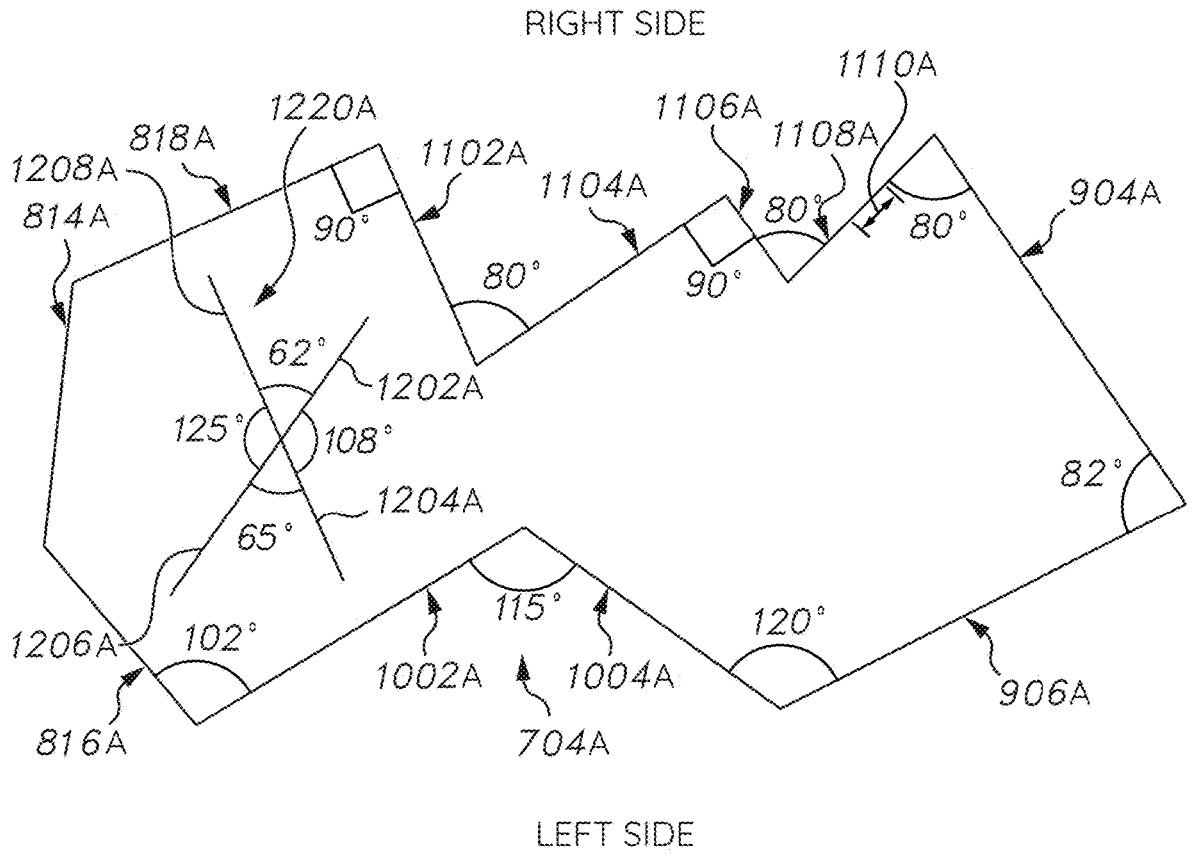
FIG. 18 is a top view illustrating the central exhaust sound attenuation element of FIG. 16 in isolation from other components of the exhaust sound attenuation and control system of FIG. 16.
Figure 19:
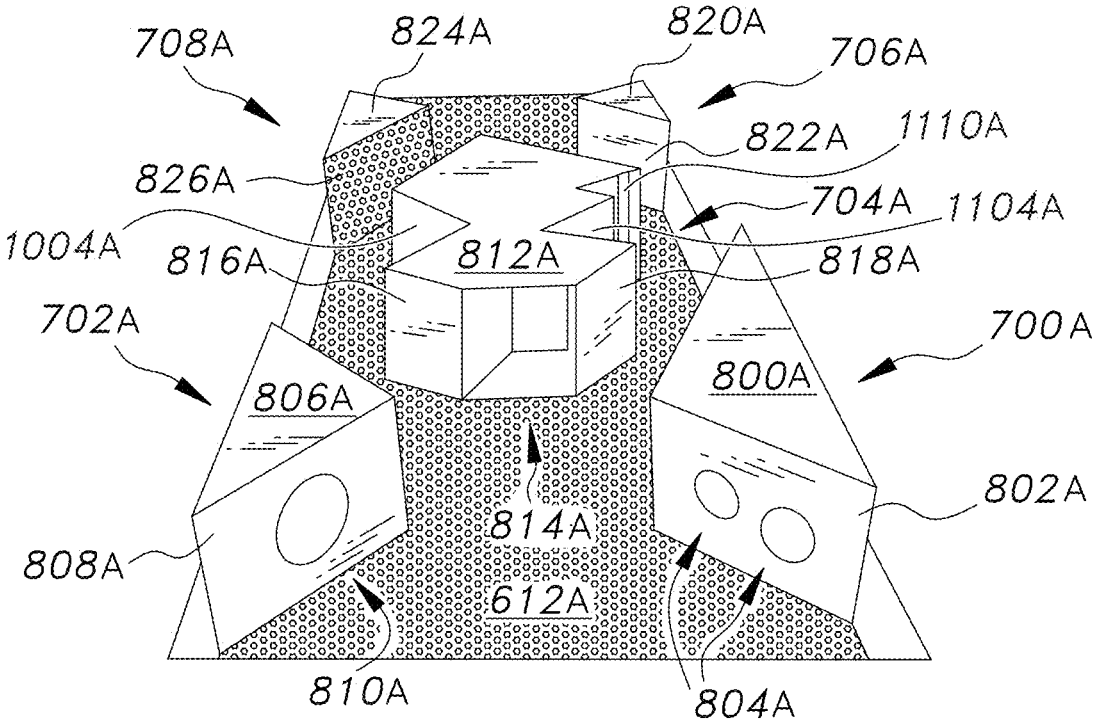
FIG. 19 is a perspective view of the central exhaust sound attenuation element of FIG. 16 as seen from in front of the element, with its cover removed to show the internal components thereof.

The right rear sidewall 904A is attached to and extends at about 82° from the left rear sidewall 906A (see FIG. 18, illustrating the about 82° angle formed between the right rear sidewall 904A and the left rear sidewall 906A at the inside of the central multi-walled baffle element 704A). Alternatively, the right rear sidewall 904A may form an angle ranging from 70° to 94° relative to the left rear sidewall 906A on the inside of the central multi-walled baffle element 704A. Extending between the left front sidewall 816A and the left rear sidewall 906A are two middle sidewalls. A first middle left sidewall 1002A is attached to and extends at about 102° from the left front sidewall 816A. Alternatively, the first middle left sidewall 1002A may form an angle ranging from 90° to 114° relative to the left front sidewall 816A aon the inside of the central multi-walled baffle element 704A. A second middle left sidewall 1004A is attached to and extends from the first middle left sidewall 1002A at an obtuse angle. For example, the first middle left sidewall 1002A and the second middle left sidewall 1004A may extend at an angle of about 115° relative to one another (as measured from the outside of the central multi-walled baffle element 704A, see FIG. 18). Alternatively, the first middle left sidewall 1002A may form an angle ranging from 103° to 127° relative to the second middle left sidewall 1004A on the outside of the central multi-walled baffle element 704A.

The first and second middle left sidewalls 1002A, 1004A are positioned between the opening 604 of the left sidewall 602 (see FIG. 6) and the opening 604 of the right sidewall (see FIG. 6). A first middle right sidewall 1102A of the central multi-walled baffle element 704A is attached to and extends at about 90° from the right front sidewall 818A on the inside of the central multi-walled baffle element 704A. Alternatively, the first middle right sidewall 1102A may form an angle ranging from 78° to 102° relative to the right front sidewall 818A on the inside of the central multi-walled baffle element 704A.

A second middle right sidewall 1104A is attached to and extends at about 80° from the first middle right sidewall 1102A on the outside of the central multi-walled baffle element 704A. Alternatively, the second middle right sidewall 1104A may form an angle ranging from 68° to 92° relative to the first middle right sidewall 1102A on the outside of the central multi-walled baffle element 704A.

A third middle right sidewall 1106A is attached to and extends at about 90° from the second middle right sidewall 1104A on the inside of the central multi-walled baffle element 704A. Alternatively, the third middle right sidewall 1106A may form an angle ranging from 78° to 102° relative to the second middle right sidewall 1104A on the inside of the central multi-walled baffle element 704A.

A fourth middle right sidewall 1108A is attached to and extends between the third middle right sidewall 1106A and the right rear sidewall 904A and extends at about 80° from both. See the about 80° angle formed between the third and fourth sidewalls 1106A, 1108A on FIG. 18 (on the outside of the central multi-walled baffle element 704A), and see the about 80° angle formed between the fourth middle sidewall 1108A and the right rear sidewall 904A on FIG. 18 (on the inside of the central multi-walled baffle element 704A). Alternatively, the fourth middle right sidewall 1108A may form an angle ranging from 68° to 92° relative to the third middle right sidewall 1106A on the outside of the central multi-walled baffle element 704A, and the fourth middle right sidewall 1108A may form an angle ranging from 68° to 92° relative to the right rear sidewall 904A on the inside of the central multi-walled baffle element 704A. The fourth middle right sidewall 1108A includes a vertical slot port 1110A close to the right rear sidewall 904A. The right sidewalls 1102A, 1104A, 1106A, 1108A are positioned between the rear opening 604A and the front opening 606A of the right sidewall. Degrees may vary as per requirements of application and tuning.

In addition, and with reference to FIG. 18, the central multi-walled baffle element 704A includes a central cross-shaped component 1220A. The central cross-shaped component 1220A virtually eliminates or substantially reduces the cabin resonance (due to the operation of the engine) from the vehicle equipped with exhaust sound attenuation and control system 100A.

Referring to FIG. 18, the central cross-shaped component 1220A includes a first sidewall 1202A, a second sidewall 1204A, a third sidewall 1206A and a fourth sidewall 1208A. Each one of the first to fourth sidewalls 1202A-1208A may be made of the same material and thickness as any of the other sidewalls of the central multi-walled baffle element 704A. For example, the first to fourth sidewalls 1202A-1208A may be made of sheet metal.

Each one of the first to fourth sidewalls 1202A-1208A extends between a bottom wall 612A of the central element 302A and a top wall 812A of the central multi-walled baffle element 704A (or to the top wall 600 (see FIG. 6) of the central element 302A when the top wall 812A of the central multi-walled baffle element 704A is omitted). In addition, the first to fourth sidewalls 1202A-1208A may be disposed between the sidewalls 818A, 1102A, 1002A and/or 816A.

Referring to FIG. 18, the first to fourth sidewalls 1202A-1208A are connected to one another. As illustrated in FIG. 18, the first and second sidewalls 1202A and 1204A are connected to one another and extend at an angle of about 108° from one another. Alternatively, the first and second sidewalls 1202A and 1204A may extend from one another by an angle ranging from 96° to 120°.

The second and third sidewalls 1204A and 1206A are connected to one another and extend at an angle of about 65° from one another. Alternatively, the second and third sidewalls 1204A and 1206A may extend from one another by an angle ranging from 53° to 77°.

The third and fourth sidewalls 1206A and 1208A are connected to one another and extend at an angle of about 125° from one another. Alternatively, the third and fourth sidewalls 1206A and 12068 may extend from one another by an angle ranging from 113° to 137°.

The fourth and first sidewalls 1208A and 1202A are connected to one another and extend at an angle of about 62° from one another. Alternatively, the fourth and first sidewalls 1206A and 1208A may extend from one another by an angle ranging from 50° to 74°.

As illustrated in FIG. 18, the first to fourth sidewalls 1202A-1208A might not extend (relative to their central connection point) to contact the sidewalls 818A, 1102A, 1002A and/or 816A. In other words, the first to fourth sidewalls 1202A-1208A might not directly contact the sidewalls 818A, 1102A, 1002A and/or 816A.

The sizes, angles, location and lengths of the first to fourth sidewalls 1202A-1208A can be changed or modified for tuning. In addition, any and all material or entire construction of the exhaust sound attenuation and control system 100A can be made out of any material adequate as per requirements of application.

It should be noted that the exhaust sound attenuation and control system is not limited to a specific shape or size. In addition, further features may be included in the system, such as emission control elements and/or coatings within the housing.

It is to be understood that the exhaust sound attenuation and control system is not limited to the specific embodiments described above but encompasses any and all embodiments within the scope of the generic language of the following claims enabled by the embodiments described herein, or otherwise shown in the drawings or described above in terms sufficient to enable one of ordinary skill in the art to make and use the claimed subject matter.

While the present disclosure has been particularly shown and described with reference to exemplary embodiments thereof, it will be apparent to those of ordinary skill in the art that various changes in form and detail may be made therein without departing from the spirit and scope of the present disclosure as defined by the following claims.

What is claimed is:

1. An exhaust sound attenuation and control system, comprising:

an outer housing having an interior, an inlet pipe extending through the outer housing and into the interior of the outer housing, and an outlet pipe extending through the outer housing and into the interior of the outer housing;

a first exhaust sound attenuation element disposed within the interior of the outer housing, the first exhaust sound attenuation element functioning primarily as a muffler and including:

a central elongated pipe having a first end and a second end, the first end receiving exhaust gasses from the inlet pipe; and a first element housing surrounding the central elongated pipe and including a rear baffle plate having a lower port through which exhaust gasses exit the first exhaust sound attenuation element;

a second exhaust sound attenuation element disposed within the interior of the outer housing, the second exhaust sound attenuation element functioning as both a muffler and a resonator and including:

a second element housing having a top wall, a left sidewall, a right sidewall, an open inlet end receiving exhaust gasses from the lower port of the first exhaust sound attenuation element, an open outlet end through which exhaust gasses exit the second exhaust sound attenuation element, and a bottom wall; and a plurality of multi-walled baffle elements within the second element housing; and a third exhaust sound attenuation element disposed within the interior of the outer housing, the third exhaust sound attenuation element functioning as both a muffler and a resonator and including:

a plurality of planar baffle plates; and a plurality of curved baffle plates.

2. The exhaust sound attenuation and control system as recited in claim 1, wherein:

the first element housing further comprises a vertical front baffle plate and a vertical central baffle plate, the vertical central baffle plate being positioned between the vertical front baffle plate and the rear baffle plate; and the central elongated pipe extends through the vertical front baffle plate and the vertical central baffle plate.

3. The exhaust sound attenuation and control system as recited in claim 2, wherein the central elongated pipe further comprises:

an inlet spaced from an inner end of the inlet pipe, forming a gap therebetween;

a plurality of first passages arranged in a radial pattern between the first end and the front baffle plate, adjacent to the front baffle plate;

a plurality of second passages arranged in triangular patterns between the front baffle plate and the central baffle plate; and a plurality of third passages between the central baffle plate and the rear baffle plate.

4. The exhaust sound attenuation and control system as recited in claim 3, wherein the front baffle plate and the central baffle plate both include at least one port therein.

5. The exhaust sound attenuation and control system as recited in claim 4, wherein:

the plurality of planar baffle plates of the third exhaust sound attenuation element comprises:

a left front baffle plate having a front edge and a back edge;

a left rear baffle plate having a front edge and a back edge;

a plurality of left intermediate baffle plates having a front edge and a back edge and extending between the left front baffle plate and the left rear baffle plate;

a right front baffle plate having a front edge and a back edge;

a right rear baffle plate having a front edge and a back edge; and a plurality of right intermediate baffle plates having a front edge and a back edge and extending between the right front baffle plate and the right rear baffle plate;

each of the plurality of curved baffle plates extends from one of the edges of the plurality of left and right intermediate baffle plates; and the edges of the left and right intermediate baffle plates are spaced apart from one another, thereby forming openings between adjacent left and right intermediate baffle plates.

6. The exhaust sound attenuation and control system as recited in claim 5, wherein:

the left front baffle plate, the left rear baffle plate, the plurality of left intermediate baffle plates, the right front baffle plate, and the plurality of right intermediate baffle plates are all solid planar baffle plates;

the right rear baffle plate is a ported planar baffle plate and includes a plurality of fourth passages therein; and the back edge of the left rear baffle plate is attached to the back edge of the right rear baffle plate.

7. The exhaust sound attenuation and control system as recited in claim 6, wherein the plurality of multi-walled baffle elements comprises:

a right, front triangular baffle element adjacent the open inlet end of the second element housing, the right, front triangular baffle element including a solid, planar, triangular top wall, a rectangular, planar front sidewall, a rectangular, planar rear sidewall, and a rectangular, planar outside wall abutting the right sidewall of the second element housing;

a left, front triangular baffle element adjacent the open inlet end of the second element housing, the left, front triangular baffle element including a solid, planar, triangular top wall, a rectangular, planar front sidewall, a rectangular, planar rear sidewall and a rectangular, planar outside wall abutting the left sidewall of the second element housing;

a central multi-walled baffle element in the center of the housing, the central multi-walled baffle element including a polygonal top wall, an open front end, and a plurality of rectangular, planar sidewalls;

a right, rear triangular baffle element adjacent the open outlet end of the housing, the right, rear triangular baffle element including a solid, planar, triangular top wall, a rectangular, planar front sidewall, a rectangular, planar rear sidewall, and a rectangular, planar outside wall abutting the right sidewall of the second element housing; and a left, rear triangular baffle element adjacent the open outlet end of the housing, the left, rear triangular baffle element including a solid, planar, triangular top wall, a rectangular, planar front sidewall, a rectangular, planar rear sidewall and a rectangular, planar outside wall abutting the left sidewall of the second element housing.

8. The exhaust sound attenuation and control system as recited in claim 7, wherein:

the rear sidewall and the outside wall of the right, front triangular baffle element are planar, rectangular, sidewalls and the rectangular, planar front sidewall is a ported sidewall with two circular ports therein;

the rear sidewall and the outside wall of the left, front triangular baffle element are planar, rectangular, sidewalls and the rectangular, planar front sidewall of the right, front triangular baffle element is a ported sidewall with single circular port therein;

the front sidewall and the outside wall of the right, rear triangular baffle element are planar, rectangular sidewalls and the rectangular, planar rear sidewall of the right, rear triangular baffle element is a ported sidewall with single slot port extending vertically at a back edge of the rear sidewall of the right, rear triangular baffle element; and the rear sidewall and the outside wall of the left, rear triangular baffle element are planar, rectangular, sidewalls.

9. The exhaust sound attenuation and control system as recited in claim 8, wherein the plurality of rectangular, planar sidewalls of the central multi-walled baffle element comprises:

a right front sidewall opposite the rear sidewall of the right front triangular baffle element and extending at an obtuse angle from the open front end;

a right rear sidewall opposite the front sidewall of the right, rear triangular baffle element;

a first middle right sidewall attached to and extending at about 90° from the right front sidewall;

a second middle right sidewall attached to and extending at about 80° from the first middle right sidewall;

a third middle right sidewall attached to and extending at about 90° from the second middle right sidewall;

a fourth middle right sidewall attached to and extending between and at about 80° from the third middle right sidewall and the right rear sidewall;

a left front sidewall opposite the solid rear sidewall of the left front triangular baffle element and extending at an obtuse angle from the open front end;

a left rear sidewall opposite the perforated front sidewall of the left, rear triangular baffle element and attached to and extending at about 82° from the right rear sidewall;

a first middle left sidewall attached to and extending at about 102° from the left front sidewall; and a second middle left sidewall attached to and extending from the first middle left sidewall at an obtuse angle and attached to and extending from the left rear sidewall at an obtuse angle.

10. The exhaust sound attenuation and control system as recited in claim 9, wherein the fourth middle right sidewall includes a vertical slot port adjacent to the right rear sidewall.

11. The exhaust sound attenuation and control system as recited in claim 10, wherein:

the right sidewall of the second element housing includes a front opening and a rear opening;

the left sidewall of the second element housing includes a front opening and a rear opening;

the middle right sidewalls are positioned between the rear opening and the front opening of the right sidewall; and the middle left sidewalls are positioned between the rear opening and the front opening of the left sidewall.

12. The exhaust sound attenuation and control system as recited in claim 11, further comprising:

an upper arcuate flow guide directing the gasses leaving the first exhaust sound attenuation element into the second exhaust sound attenuation element; and a lower arcuate flow guide directing the gasses leaving the second exhaust sound attenuation element into the third exhaust sound attenuation element.

13. The exhaust sound attenuation and control system as recited in claim 12, wherein:

the outer housing further comprises a vertical front panel and a vertical rear panel; and the exhaust sound attenuation and control system further comprises:

an upper element support plate attached to the vertical front panel using an upper element support plate bracket, the upper element support plate supporting the first element and separating the first element from the second element;

a lower element support plate attached to the rear panel and extending perpendicularly therefrom, the lower element support plate supporting the second element and separating the second element from the third element.

14. The exhaust sound attenuation and control system as recited in claim 13, wherein at least a portion of one of the upper arcuate flow guide and a rear portion of the lower element support plate is perforated to allow a portion of the gasses exiting the first element to bypass the second element and the third element before exiting the system via the outlet pipe.

15. The exhaust sound attenuation and control system as recited in claim 1, wherein:

the plurality of planar baffle plates of the third exhaust sound attenuation element comprises:

a left front baffle plate having a front edge and a back edge;

a left rear baffle plate having a front edge and a back edge;

a plurality of left intermediate baffle plates having a front edge and a back edge and extending between the left front baffle plate and the left rear baffle plate;

a right front baffle plate having a front edge and a back edge;

a right rear baffle plate having a front edge and a back edge; and a plurality of right intermediate baffle plates having a front edge and a back edge and extending between the right front baffle plate and the right rear baffle plate; and each of the plurality of curved baffle plates extends from one of the edges of the plurality of left and right intermediate baffle plates; and the edges of the left and right intermediate baffle plates are spaced apart from one another, thereby forming openings between adjacent left and right intermediate baffle plates.

16. The exhaust sound attenuation and control system as recited in claim 15, wherein:

the left front baffle plate, the left rear baffle plate, the plurality of left intermediate baffle plates the right front baffle plate and the plurality of right intermediate baffle plates are all planar baffle plates;

the right rear baffle plate is a ported planar baffle plate and includes a plurality of fifth passages therein; and the back edge of the left rear baffle plate is attached to the back edge of the right rear baffle plate.

17. The exhaust sound attenuation and control system as recited in claim 16, further comprising:

an upper arcuate flow guide directing the gasses leaving the first exhaust sound attenuation element into the second exhaust sound attenuation element; and a lower arcuate flow guide directing the gasses leaving the second exhaust sound attenuation element into the third exhaust sound attenuation element.

18. The exhaust sound attenuation and control system as recited in claim 17, wherein the outer housing further comprises a vertical front panel and a vertical rear panel, the exhaust sound attenuation and control system further comprising:

an upper element support plate attached to the vertical front panel using an upper element support plate bracket, the upper element support plate supporting the first element and separating the first element from the second element;

a lower element support plate attached to the rear panel and extending perpendicularly therefrom, the lower element support plate supporting the second element and separating the second element from the third element.

19. The exhaust sound attenuation and control system as recited in claim 18, wherein at least a portion of one of the upper arcuate flow guide and a rear portion of the lower element support plate is perforated to allow a portion of the gasses exiting the first element to bypass the second element and the third element before exiting the system via the outlet pipe.

20. The exhaust sound attenuation and control system as recited in claim 8, wherein the plurality of rectangular, planar sidewalls of the central multi-walled baffle element comprises:

a right front sidewall opposite the rear sidewall of the right front triangular baffle element and extending at an obtuse angle from the open front end;

a right rear sidewall opposite the front sidewall of the right, rear triangular baffle element;

a first middle right sidewall attached to the right front sidewall and extending at an angle ranging from 78° to 102° relative to the right front sidewall;

a second middle right sidewall attached to the first middle right sidewall and extending at an angle ranging from 78° to 102° relative to the first middle right sidewall;

a third middle right sidewall attached to the second middle right sidewall and extending at an angle ranging from 78° to 102° relative to the second middle right sidewall;

a fourth middle right sidewall attached to and extending between the third middle right sidewall and the right rear sidewall, the fourth middle right sidewall extending at an angle ranging from 68° to 92° relative to the third middle right sidewall, and extending at an angle ranging from 68° to 92° relative to the right rear sidewall;

a left front sidewall opposite the solid rear sidewall of the left front triangular baffle element and extending at an obtuse angle from the open front end;

a left rear sidewall opposite the perforated front sidewall of the left, rear triangular baffle element and attached to the right rear sidewall, the left rear sidewall extending at an angle ranging from 70° to 94° relative to the right rear sidewall;

a first middle left sidewall attached to the left front sidewall and extending at an angle ranging from 90° to 114° relative to the left front sidewall; and a second middle left sidewall attached to and extending from the first middle left sidewall at an obtuse angle and attached to and extending from the left rear sidewall at an obtuse angle.

21. The exhaust sound attenuation and control system as recited in claim 20, wherein the central multi-walled baffle element further includes a central cross-shaped component disposed between the right front sidewall, the first middle right sidewall, the first middle left sidewall and the left front sidewall, the central cross-shaped component comprising:

a first sidewall;

a second sidewall connected to the first sidewall and extending at an angle of about 108° from the first sidewall;

a third sidewall connected to the second sidewall and extending at an angle of about 65° from the second sidewall; and a fourth sidewall connected to the third sidewall and extending at an angle of about 125° from the third sidewall, wherein the fourth sidewall is further connected to the first sidewall and extends at an angle of about 62° from the first sidewall.

22. An exhaust sound attenuation and control system, comprising:

an outer housing having an interior, an inlet pipe extending through the outer housing and into the interior of the outer housing, and an outlet pipe extending through the outer housing and into the interior of the outer housing;

a first exhaust sound attenuation element disposed within the interior of the outer housing, the first exhaust sound attenuation element functioning primarily as a muffler and including:

a central elongated pipe with a first end and a second end, the first end receiving exhaust gasses from the inlet pipe; and a first element housing surrounding the central elongated pipe and including a vertical front baffle plate, a vertical central baffle plate, and a vertical rear baffle plate;

a second exhaust sound attenuation element disposed within the interior of the outer housing, the second exhaust sound attenuation element functioning as both a muffler and a resonator and including:

a second element housing having a top wall, a left sidewall, a right sidewall, an open inlet end receiving exhaust gasses from the lower port of the first exhaust sound attenuation element, an open outlet end through which exhaust gasses exit the second exhaust sound attenuation element, and a bottom wall; and a plurality of multi-walled baffle elements within the second element housing; and a third exhaust sound attenuation element disposed within the interior of the outer housing, the third exhaust sound attenuation element functioning as both a muffler and a resonator and including:

a left front baffle plate having a front edge and a back edge;

a left rear baffle plate having a front edge and a back edge;

a plurality of left intermediate baffle plates having a front edge and a back edge and extending between the left front baffle plate and the left rear baffle plate;

a right front baffle plate having a front edge and a back edge;

a right rear baffle plate having a front edge and a back edge;

a plurality of right intermediate baffle plates having a front edge and a back edge and extending between the right front baffle plate and the right rear baffle plate; and a plurality of curved baffle plates extending from one of the edges of the plurality of left and right intermediate baffle plates; and wherein:

the central elongated pipe extends through the vertical front baffle plate and the vertical central baffle plate; and the vertical rear baffle plate seals the second end of the central elongated pipe; and the edges of the left and right intermediate baffle plates are spaced apart from one another, thereby forming openings between adjacent left and right intermediate baffle plates.

* * * * *